US007528082B2

(12) United States Patent
Krans et al.

(10) Patent No.: US 7,528,082 B2
(45) Date of Patent: May 5, 2009

(54) FABRIC

(75) Inventors: Jan M. Krans, Den Bosch (NL); Michel P. B. Bruggen, Helmond (NL); Jacob M. J. Den Toonder, Helmond (NL); Johannes T. A. Wilderbeek, Veghel (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 306 days.

(21) Appl. No.: 10/598,182

(22) PCT Filed: Feb. 17, 2005

(86) PCT No.: PCT/IB2005/050596

§ 371 (c)(1),
(2), (4) Date: Aug. 21, 2006

(87) PCT Pub. No.: WO2005/086128

PCT Pub. Date: Sep. 15, 2005

(65) Prior Publication Data

US 2008/0161186 A1 Jul. 3, 2008

(30) Foreign Application Priority Data

Feb. 25, 2004 (GB) ..... 0404137.2

(51) Int. Cl.
*D03D 15/00* (2006.01)

(52) U.S. Cl. ..... 442/301; 442/203; 442/204; 442/312

(58) Field of Classification Search ..... 442/203, 442/204, 301, 312
See application file for complete search history.

(56) References Cited

U.S. PATENT DOCUMENTS

| | | | | |
|---|---|---|---|---|
| 4,639,545 | A * | 1/1987 | Pithouse et al. | 174/36 |
| 5,962,967 | A * | 10/1999 | Kiryuschev et al. | 313/491 |
| 6,490,402 | B1 | 12/2002 | Ota | |
| 6,969,185 | B1 * | 11/2005 | Adair | 362/542 |
| 2002/0187697 | A1 | 12/2002 | Kiryuschev et al. | |

FOREIGN PATENT DOCUMENTS

WO WO2005086128 A1 9/2005

* cited by examiner

*Primary Examiner*—Andrew T Piziali

(57) ABSTRACT

A fabric (2; 20) formed from a plurality of first fibers or filaments (4), and a plurality of second fibers or filaments (6); the first fibers or filaments being non-conductive and comprising an electro-optically active material; and the second fibers or filaments being conductive; whereby a voltage difference between two second fibers causes a colour change in a first fiber positioned therebetween.

17 Claims, 2 Drawing Sheets

FABRIC

Figure 1:
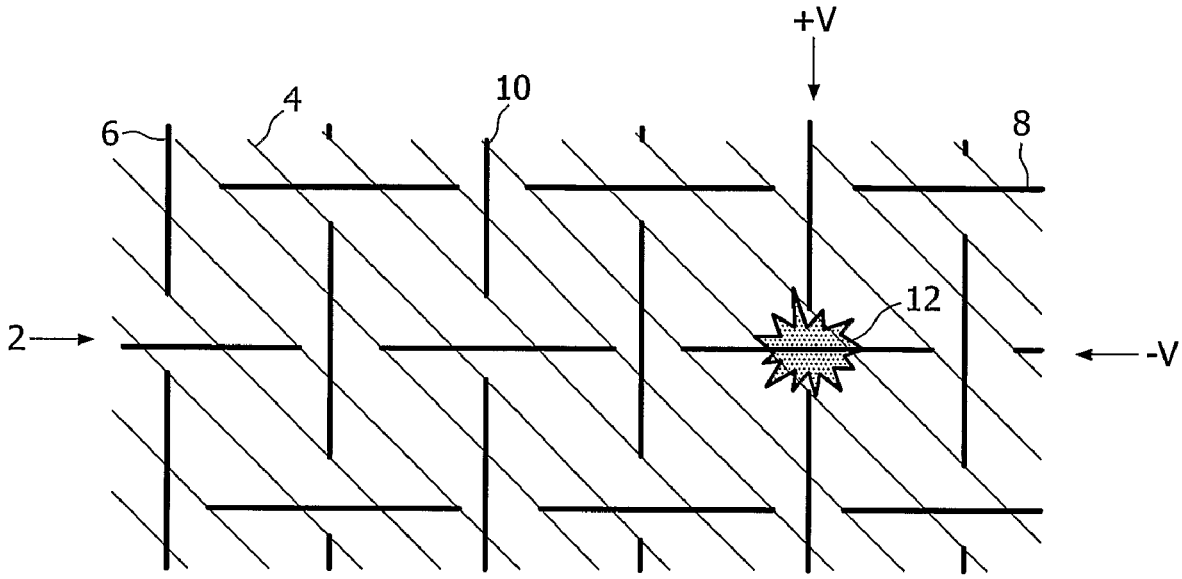

This invention relates to a fabric, especially one that is made from filaments or fibres, at least some of which have electro-optical properties.

Various methods of producing colour changing, or light emitting effects in fabrics are known.

One known method and fabric is disclosed in US patent application No. US 2002/0187697 assigned to Visson IP LLC Inc. The fabric disclosed therein is formed from first and second sets of fibres, each fibre having a longitudinal conductive element. The two sets of fibres form a matrix structure of junctions, and the structure further comprises an electro-optically active substance which coats at least partially the fibres of the first set. A voltage difference exists between the longitudinal conductive elements of the fibres of the first set, and those of the second set where a fibre from each set meets at a junction. The junction formed by a fibre of the first set crossing over with the fibre of the second set activates the electro-optically active material and produces a display element.

U.S. Pat. No. 6,490,402 describes a material formed from a light-emitting diode (LED) matrix formed from an interweaved weft of conductive strands and a warp of light-emitting diode (LED) fibre formed from a conductive core coated with a p-doped semiconductor and then an n-doped semiconductor of light-emitting polymer. Each conductive strand physically and electrically couples to each LED fibre at one location to form a LED that may be activated as a pixel.

A problem with these existing methods and fabrics is that all of the fibres used to create the known fabrics comprise a longitudinal conductive core electrode. Some of the fibres further comprise an electro-optically active substance. Manufacture of such fibres is complicated and therefore expensive. In addition, fibres containing a core electrode in conjunction with electro-optically active material will be relative thick and stiff, thereby complicating any process such as a weaving process used to form fabric from such fibres.

It is an object of the present invention to provide a fabric, or material, which overcomes these problems.

According to a first aspect of the present invention, there is provided a fabric formed from a plurality of first fibres or filaments, and a plurality of second fibres or filaments;

the first fibres or filaments being non-conductive and comprising an electro-optically active material; and the second fibres or filaments being conductive, whereby a voltage difference between two second fibres causes a colour change in a first fibre positioned therebetween.

By means of the present invention, it is possible to form a fabric from a first set of fibres, each of which is formed from a conductive material, and a second set of fibres, each of which is formed from an electro-optically active material, without having to incorporate an elongate conductive core within the fibres formed from the electro-optically active material.

Such a fabric is therefore, cheaper than known similar fabrics. In addition any processes used to form the fabric such as weaving or knitting processes are less complicated because it is not necessary to use relatively thick and stiff fibres comprising a core electrode and an electro-optically active substance.

The second fibres may further comprise an electro-optically active material.

According to a second aspect of the present invention, there is provided a method of forming a fabric comprising interlacing a plurality of first fibres or filaments with a plurality of second fibres or filaments, the first fibres being non-conductive and comprising an electro-optically active material, and the second fibres being conductive.

The first fibres are preferably interwoven, knitted or crocheted so that they interlace with the second fibres.

At least a first plurality of the first fibres or filaments extend in a first direction and are interlaced with a first plurality of second fibres or filaments that extend in a second direction.

A voltage difference is created between pairs of the second fibres or filaments at points at which the second fibres or filaments overlap or cross with one another. This voltage difference causes a colour change in any first fibres which are positioned between one or more such pairs of second fibres, at least in a portion of any of the first fibres near to points at which the second fibres or filaments overlap or cross with one another.

A different colour change may be induced in different parts of each first fibre by applying different voltages to different second fibres. Alternatively or in addition, one or more first fibres may be formed from different electro-optically active material to other of the first fibres.

Preferably, the second direction is substantially different to the first direction thereby reducing the extent to which the first fibres or filaments are obscured by second fibres or filaments.

Advantageously, the fabric is formed from a second plurality of second fibres or filaments that extend in a third direction. This means that the conductive fibres will extend in two directions.

Preferably, the third direction is substantially different to the first direction and to the second direction. This enables a fabric to be created by, for example, weaving, in which the first plurality of second fibres will cross with the second plurality of fibres whilst at the same time reducing the extent to which the first fibres or filaments are obscured by second fibres or filaments.

Advantageously, the second and third directions are substantially orthogonal.

The first direction may form any desirable angle with the first and third directions, but preferably, the first direction forms an angle of substantially 45° with either the second or the third direction.

When the second and third directions are substantially orthogonal to one another, the first direction will form an angle of substantially 45° with each of the second and third directions. The resultant fabric will have a multiaxially weave structure known as a triaxial weave pattern.

Advantageously, the fabric comprises a second plurality of the first fibres or filaments each of which extends in a fourth direction. Preferably the fourth direction is different to the first direction and to each of the second and third directions.

Advantageously, the first and fourth directions are substantially orthogonal to one another, and the second and third directions are also substantially orthogonal to one another, the first and fourth directions forming an angle of substantially 45° with the second and third directions respectively. Such an arrangement will result in a quadraxial weave pattern.

By means of the present invention, a fabric, particularly a woven fabric can be produced in which local change of colour can be induced in one or more of the first fibres by creating an electric field across that fibre or fibres, by means of the conducting second fibres. This allows for a local colour change in fabrics, which is achievable without the need to form a colour change fibre with a conductive element incorporated therein.

The maximum voltage range applied across a first fibre by means of the conducting second fibres will depend upon the optically active material forming the first fibre, and to the geometry of the first fibre.

In some cases, it will be necessary to apply an alternating voltage across a first fibre due to the nature of the optically active material forming that first fibre. In other cases, due to the nature of the optically active material forming a first fibre, it will be necessary to apply a direct voltage across the first fibre.

Some optically active materials require a short voltage burst only to be applied across them in order to produce a "frozen" optical effect. Examples of such optically active materials are bistable materials, for example, electrophoretic materials.

The first fibres or filaments, and the second fibres or filaments may have any desirable dimensions, and typically will have diameters falling within the range of 10 to 1000 μm.

The first and second fibres or filaments may have any desirable cross-section, for example, they may have a circular cross section. Alternatively, either of the first and second fibres or filaments may comprise substantially rectangular ribbon like fibres having a substantially rectangular cross section.

It may be particularly advantageous for the first fibres or filaments to comprise ribbon like fibres having, for example, a substantially rectangular cross section.

The electro-optically active material forming the first fibres or filaments may take any appropriate form and may comprise, for example, liquid crystal, polymer LED material, electroluminescent material, electrophoretic material, light modulation material that imitates pigment cells in nature.

Figure 2:
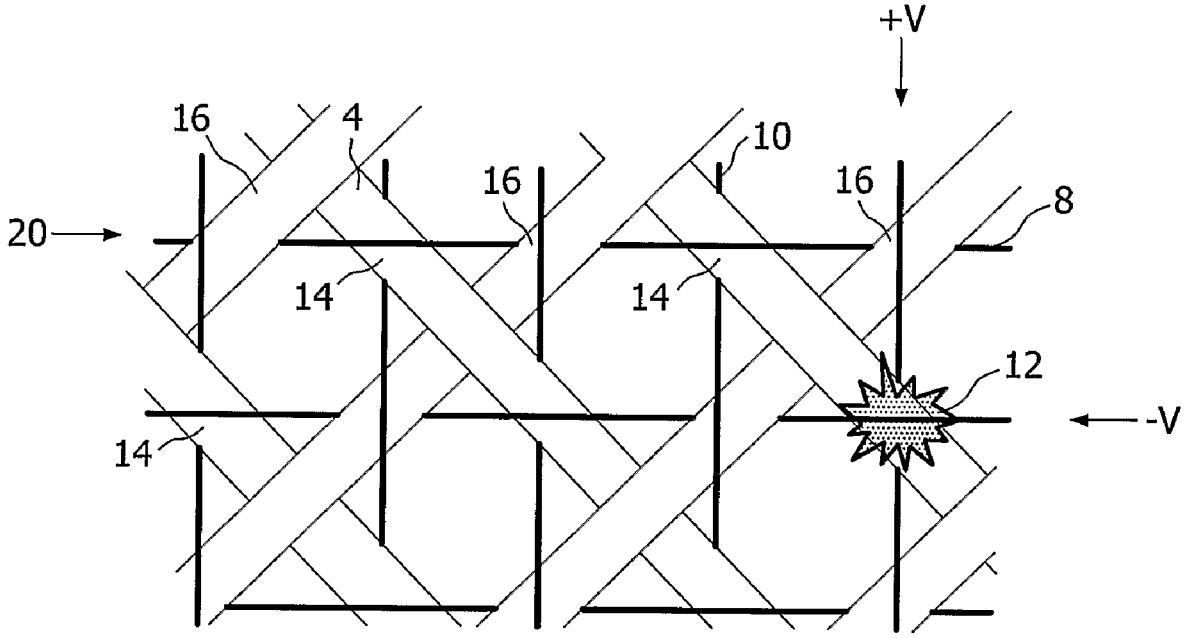

The invention will now be further described by way of example only with reference to the accompanying drawings in which:

FIG. 1 is a schematic representation of a first embodiment of the present invention showing a triaxial weave pattern; and FIG. 2 is a schematic representation of a second embodiment of the present invention showing a quadraxial weave pattern.

Referring to FIG. 1, a fabric according to a first embodiment of the present invention is designated generally by the reference numeral 2.

The fabric is formed from a plurality of first fibres 4 and a plurality of second fibres 6. Each of the first fibres 4 is formed from an electro-optically active substance enclosed within a transparent or translucent core.

All the first fibres may be formed from the same substance. Alternatively, one or more of the first fibres may be formed from a different electro-optically active material to that from which other of the first fibres are formed. Each second fibre 6 is formed from a conductive material. The first fibres 4 are interlaced with the second fibres 6.

The fabric 2 is formed from a first plurality 8 of second fibres, which in this example, are shown as extending horizontally, and a second plurality 10 of second fibres, which in this example, are shown extending vertically. The first plurality 8 of second fibres therefore extends in a direction substantially orthogonal to the direction in which the second plurality 10 of second fibres extends. In this example, the first fibres 4 extend in a direction that forms an angle of approximately 45° with the direction in which each plurality 8,10 of the second fibres extends.

Each of the first plurality 8 of the second fibres overlaps with each of the second plurality 10 of second fibres at junctions 12, and first fibres 4 pass through the junctions 12 as shown in FIG. 1.

By applying a voltage difference between one of the second fibres 8 and one of the second fibres 10, a local electric field is induced at one of the junctions 12. As a result, a first fibre 4 passing through this junction changes colour in the vicinity of the junction. In this example, one of the second fibres 8 has a voltage +V applied to it, and one of the second fibres 10 has a voltage +V applied to it.

By applying a voltage difference between each of the second fibres 8 and each of the second fibres 10, each first fibre 4 is induced to change colour in the vicinity of every junction.

The weave pattern of the fabric shown in FIG. 1 is a triaxial weave pattern.

Referring now to FIG. 2, a fabric according to a second embodiment of the present invention is designated generally by the reference numeral 20. The fabric 20 is similar to the fabric 2 illustrated in FIG. 1, and corresponding parts have been given corresponding reference numerals for ease of reference.

In this embodiment, the first fibres comprise a first plurality 14 of first fibres, and a second plurality 16 of first fibres.

The first fibres therefore extend in two directions, which in this example, are substantially orthogonal to one another. The first plurality 14 of first fibres extends in a first direction, the first plurality 8 of second fibres extends in a second direction, the second plurality 10 of second fibres extends in a third direction, and the second plurality 16 of first fibres extends in a fourth direction. Each of the first, second, third and fourth directions is different to one another, and in this example the first and fourth directions are substantially orthogonal to one another, and the second and third directions are substantially orthogonal to one another.

In this example, the second and third directions are shown as extending horizontally and vertically respectively, and the first and fourth directions each form an angle of approximately 45° with each of the second and third directions.

The fabric shown in FIG. 4 has a quadraxial weave pattern.

A fabric according to the present invention may be used to make a wide range of different products, such as garments, curtains, carpets, wallpaper, soft furnishings etc.

The invention claimed is:

1. A fabric (2; 20) formed from a plurality of first fibres or filaments (4), and a plurality of second fibres or filaments (6);

the first fibres or filaments being non-conductive and comprising an electro-optically active material; and the second fibres or filaments being conductive;

whereby a voltage difference between two second fibres causes a colour change in a first fibre positioned therebetween.

2. A fabric (2; 20) according to claim 1 wherein the first fibres or filaments (4) are interlaced with the second fibres or filaments (6).

3. A fabric (2; 20) according to claim 1 wherein a first plurality (14) of the first fibres or filaments extends in a first direction and a first plurality (8) of the second fibres or filaments extends in a second direction.

4. A fabric (2; 20) according to claim 3 wherein the second direction is substantially different to the first direction.

5. A fabric (2; 20) according to claim 3 wherein a second plurality (10) of the second fibres or filaments extend in a third direction.

6. A fabric (2; 20) according to claim 5 wherein the third direction is substantially different to the first direction.

7. A fabric (2; 20) according to claim 5 wherein the second direction is orthogonal to the third direction.

8. A fabric (2; 20) according to claim 3 wherein a second plurality (16) of the first fibres or filaments extends in a fourth direction.

9. A fabric (2; 20) according to claim 8, wherein the first direction is orthogonal to the fourth direction.

10. A fabric (2; 20) according to claim 1 wherein one or more of the second fibres comprises an electro-optically active material.

11. A fabric (2; 20) according to claim 1, wherein the plurality of first fibres is formed from a plurality of electro-optically active materials.

12. A fabric (2; 20) according to claim 1, which fabric is woven, knitted or crocheted.

13. A fabric (2; 20) according to claim 1 wherein the fabric is woven, and the first fibres or filaments are interwoven with the second fibres or filaments.

14. A garment formed from a fabric (2; 20) according to claim 1.

15. A method of forming the fabric (2; 20) of claim 1 comprising interlacing a plurality of first fibres or filaments (4) with a plurality of second fibres or filaments (8), the first fibres being non-conductive and comprising an electro-optic material, and the second fibres being conductive.

16. A method according to claim 15 wherein the step of interlacing the first fibres or filaments (4) with the second fibres or filament (8) comprises weaving the first and second fibres or filaments together.

17. A method according to claim 14 further comprising applying a voltage difference between overlapping second fibres or filaments (8).

* * * * *